US007661906B2

(12) United States Patent
Austin

(10) Patent No.: US 7,661,906 B2
(45) Date of Patent: Feb. 16, 2010

(54) WOODPILE CONNECTOR

(76) Inventor: Howard C. Austin, 2417 Sharon St., Kenner, LA (US) 70062-0480

( * ) Notice: Subject to any disclaimer, the term of this patent is extended or adjusted under 35 U.S.C. 154(b) by 0 days.

(21) Appl. No.: 12/080,865

(22) Filed: Apr. 7, 2008

(65) Prior Publication Data

US 2009/0249735 A1 Oct. 8, 2009

(51) Int. Cl.
*E02D 5/08* (2006.01)

(52) U.S. Cl. ..... 405/251

(58) Field of Classification Search ..... 405/250, 405/251, 252

See application file for complete search history.

(56) References Cited

U.S. PATENT DOCUMENTS 3,003,323 A * 10/1961 Holt ..... 405/251
3,802,206 A * 4/1974 Moore et al. ..... 405/251
4,431,347 A 2/1984 Gillen
4,525,102 A 6/1985 Gillen
4,537,534 A * 8/1985 Marsh, Jr. ..... 405/251
5,593,251 A 1/1997 Gillen
H2080 H 9/2003 Bourgeois
6,979,151 B1 * 12/2005 Bourgeo ..... 405/251

* cited by examiner

*Primary Examiner*—Frederick L Lagman
(74) *Attorney, Agent, or Firm*—Keaty Law Firm

(57) ABSTRACT

A woodpile connector has a tubular body defined by an open-end lower portion and an open-end upper portion. The upper portion and the lower portion are fixedly connected, at their free ends, to a separating plate, which is secured between an inner surface and an outer surface of the tubular body. The open ends of the connector body have beveled edges to facilitate compression of the wood being forced into the connector body. By aligning the connector portions in relation to the pile sections, while forcing the connector portions into the ends of the adjoining pile sections, alignment of the pile sections is achieved even when the pile sections do not have evenly cut connecting surfaces.

14 Claims, 2 Drawing Sheets

WOODPILE CONNECTOR

BACKGROUND OF INVENTION

This invention relates to a pile system, and more particularly to a connector for engaging ends of pile segments when the pile is driven into the ground.

Many construction projects involve the use of wooden piles that are designed to support the structure above ground. The use of woodpiles is widespread in the areas where the soil conditions do not provide sufficient structural support to a building or other structure. Such areas can be found in sandy soils or in clay soils with large moisture content. Builders in the South of the United States are well familiar with the weak soil conditions and conventionally use woodpiles in support structures. One of the cities that is practically built on piles is New Orleans, La., where the clay conditions of the soil require the use of piles even in a small house construction.

In the past, the piles were made of cypress wood that was especially resistant to rot and termites. Eventually, the supplies of long timber were exhausted and modern builders have to utilize 30-foot piles as opposed to 60-foot piles that were available even a century ago. As a result, when a particularly heavy structure needs to be erected, the pile segments have to be connected end-to-end and driven into the ground.

The problem with using smaller length piles is that the pile segments can deviate from the desired strictly vertical orientation, which will result in weakening of the pile system. The weakening of the pile system can also be created when the ends of the piles not being cut strictly level, which will tend to place the upper segment of the pile at an angle in a relation to a vertical axis of the lower pile segment.

Various devices have been used to prevent weakening of the pile system. One of them is the use of a cylindrical sleeve that fits over the area of connection between the two pile segments. Such sleeves are conventionally squeezed around the abutting ends of the pile segments and tend to "grip" the pile segments as they are driven into the soil. However, this system is not perfect and deviations from the strictly vertical orientation of the pile when using this system have been noted.

The present invention contemplates elimination of drawbacks associated with the prior art and provision of a woodpile connector that would help retain the pile segments in a vertical orientation regardless of the cut level of the connecting segments.

SUMMARY OF THE INVENTION

It is, therefore, an object of the present invention to provide a woodpile connector that stabilizes the pile segments for retaining them in a vertical orientation as they are driven into the soil.

It is another object of the present invention to provide a woodpile connector that retains the pile segments in a vertical orientation even when the ends of the pile are not cut at a straight angle.

It is a further object of the present invention to provide a woodpile connector that is easy to use and inexpensive to manufacture.

These and other objects of the present invention are achieved through a provision of a connector for use with porous piles, such as woodpiles. The connector has a cylindrical body intersected by a separating plate in its mid section. The separating plate divides the connector into an upper portion and a lower portion, which is a mirror image of the upper portion. The connector portions have opposite open ends. The connector wall that defines the open edges of the connector body is cut at a bevel and forms a sharpened edge to facilitate embedding of the connector ends into abutting pile segments and imparting a compression force on the pile section inserted into the pile segment end. The soft fibrous matter of the woodpile becomes compressed within the annular space defined by the interior wall of the connector, which helps prevent splitting of wood in the area of connection.

A pair of bleed openings is formed in the pile connector between the separating plate and the edge of the pile connector portions that are attached to the plate. The bleed openings allow air and moisture to escape the connector portions when the connector is embedded into the wood segments. The bleed openings may be formed at diametrically opposite locations about the circumference of the connector body.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
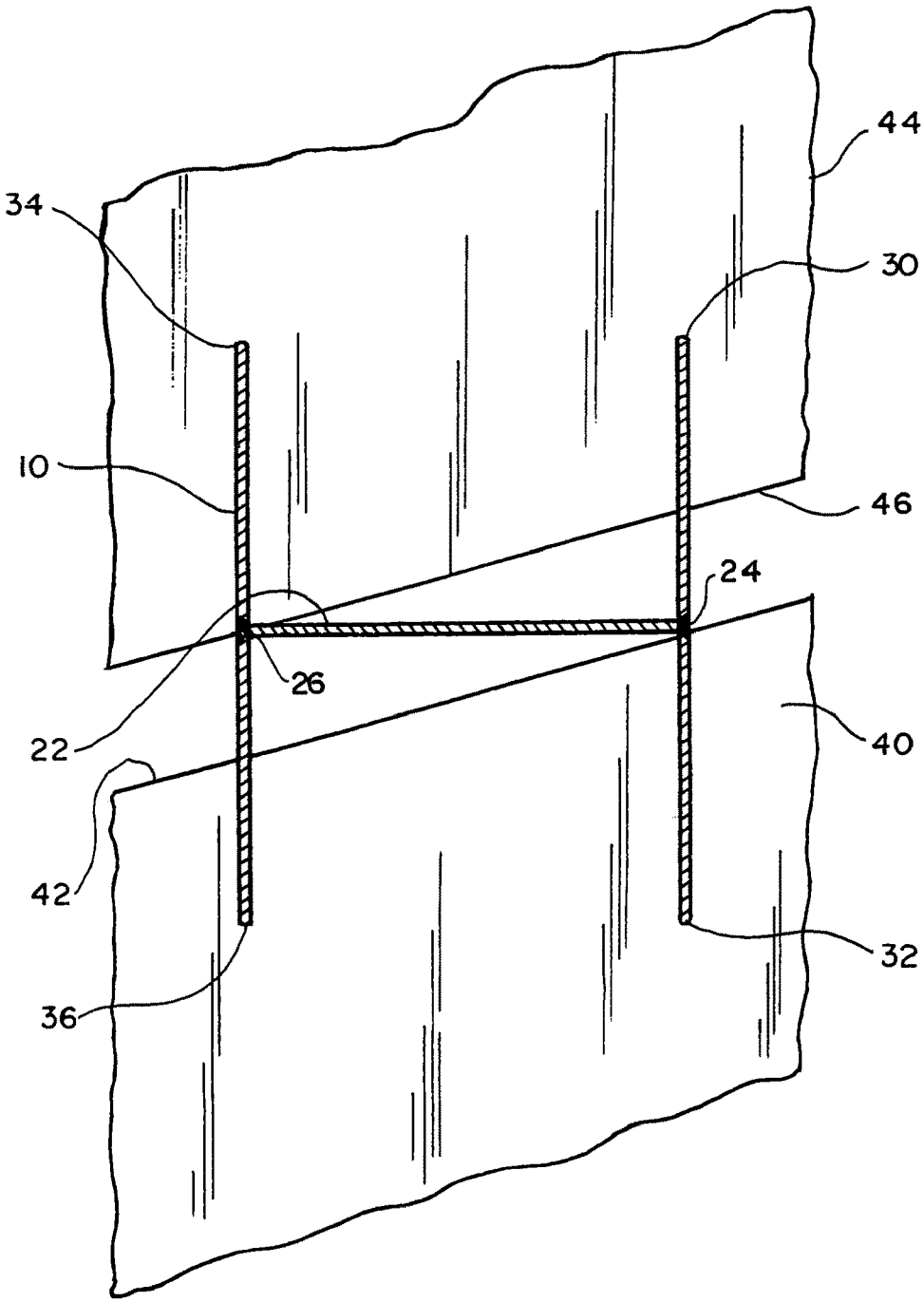
FIG. 1 is a schematic view showing the wood pile connector of the present invention engaging two segments of a pile.
Figure 2:
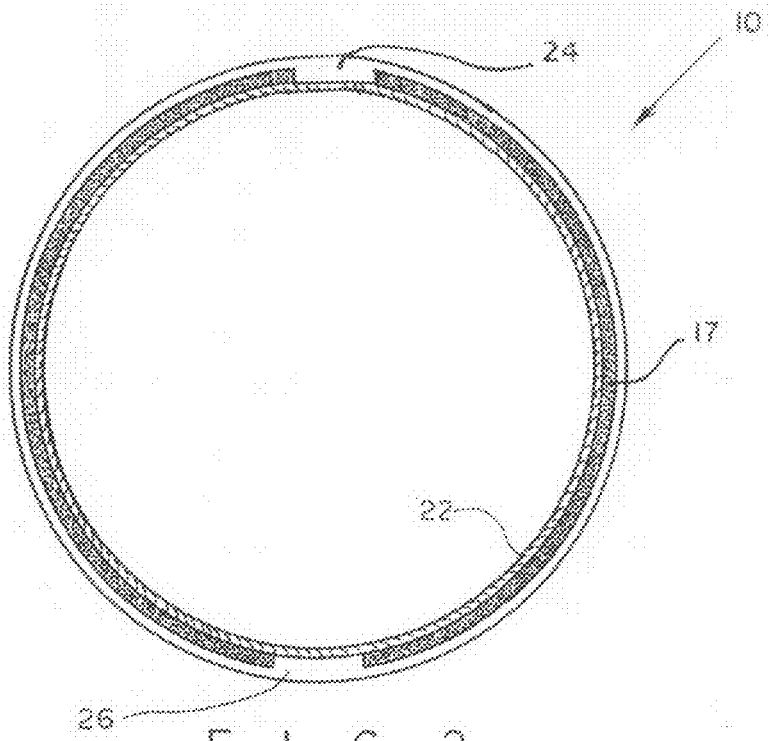
FIG. 2 is a plan view of the pile connector in accordance with the present invention.
Figure 3:
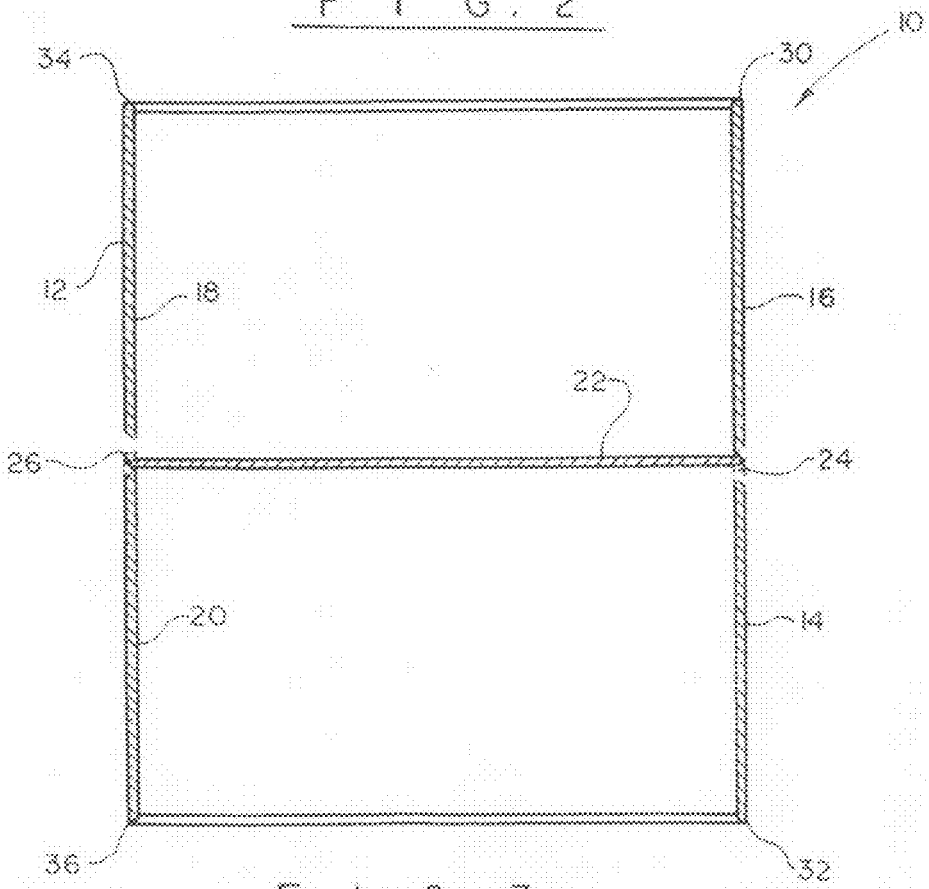
FIG. 3 is a longitudinal sectional view of the pile connector of the present invention.

Turning now to the drawings in more detail, numeral 10 designates the woodpile connector in accordance with the present invention. As can be seen in the drawing, the pile connector 10 has a generally tubular body open at a first upper portion 12 and at a second lower portion 14. The portions 12 and 14 are fixedly joined together, such as by welding 17 to form a continuous exterior wall 16. The inner wall 18 of the upper portion 12 is interrupted by a separating plate 22, which separates the upper portion 12 from the lower portion 14. An inner portion 20 of the lower portion 14 is similarly intersected by the separating plate 22. The separating plate 22 thereby defines the bottom of the upper portion 12 and a top of the lower portion 14 of the connector 10.

The separating plate 22 has a diameter slightly smaller than the diameter of the wall 16, such that a weld is made between the cylindrical body of the upper portion 12, the lower portion 14 and the peripheral edge of the separating plate 22 to join the three component parts together. A pair of fluid release openings, or bleed slots 24, 26 is made at diametrically opposite positions in relation to the center of the cylindrical wall 16, although it is not absolutely necessary. The bleed slots 24, 26 are formed in the separating plate 22 to allow air to escape to on top and of bottom of the separating plate 22.

The upper edge of the wall 16 is provided with an inwardly inclined bevel edge 30, and a lower edge of the wall 16 is provided with an inwardly inclined bevel edge 32. The annular edges 30 and 32 create sharp points 34 and 36, respectively. The sharpened points 34 and 36 assist in driving the pile connector 10 into the wooden log, while forcing the wood fibers to compress, at least to the annular space between the interior walls 18 and 20 of the pile connector portions 12 and 14.

When a pile needs to be driven into the soil, the pile is cut cross-wise to a desired length. FIG. 1 shows two such pile segments. A bottom pile segment 40 has a top end 42 which may or may not be cut straight. In FIG. 1, the bottom pile 40 is cut at about a 10-degree angle away from the vertical.

A second pile segment, in this case top pile segment 44 is also cut crosswise to create an abutting end 46. The end 46 may or may not be cut at a straight angle. FIG. 1 shows that the end 46 has about a 15-degree angle. It is with such type of problems that the device 10 of the present invention is designed to deal.

In operation, the bottom pile 40, which can be an untreated wood pile, is driven into the soil using conventional pile driving equipment. The pile connector 10 is then positioned at approximately central location on the top end 42. The operator needs to make sure that the connector 10 is oriented vertically regardless of the angle that is exhibited by the top surface of the end 42. Downward force is then applied to the pile 40 and the connector 10, forcing the lower connector portion 14 downwardly. The lower connector portion 14 becomes deeply embedded into the end 42 of the bottom pile segment 40 with the help of the sharpened annular edge 36.

The wooden fibers, being relatively soft and capable of being compressed by the metal connector 10 tend to be "squeezed" or compressed between the interior wall 20 of the connector portion 14. This insures that the connector 10 is firmly embedded into the bottom pile 40.

Regardless of whether the full surface of the separating plate 22 contacts the cut surface 42, the connector 10 will stay oriented vertically, as long as the driving is conducted properly. If air or water were trapped inside the lower portion 14 while the connector was driven into the pile 40, the air and water, if present, are released through the bleed holes 24, 26.

Next, the operator positions the top pile segment 44 on top of the connector 10 and forces the top pile segment 44 onto the sharpened edge 34 on the upper portion 12. The top pile 44 can be a treated wood pile that is exposed to the air and moisture. The wall 16 embeds itself within the pile segment 44, compressing slightly the pile fibers between the confines of the interior wall 18 of the connector lower portion 12 thereby ensuring firm engagement of the connector 10 with the top pile segment 44.

The bottom surface 46 of the upper pile 44, even if not contacting the separating plate 22 about the entire surface of the cut end 46, will remain substantially vertical and in proper alignment with the bottom pile 40. Any trapped air or fluid will seep out through the bleed holes 24, 26.

This procedure can be followed until the desired number of piles has been driven into the soil to create a pile structure suitable for supporting the foundation of a house or building. It is possible that lower ends of some piles will become split where the connector 10 is driven into the wooden log. However, due to the slight compression of the wood body into the interior of the pile connector 10, the piles will stay connected and in the proper alignment. While the subsequent sections of pile are driven into the ground, the connector 10 will become more firmly embedded into the lower pile sections, facilitating increase in the load carrying capacity of the overall pile system.

By using the pile connector 10, the operator can straighten not so perfectly cut surfaces of the pile segments and achieve a straight alignment between the two pile sections. The connector 10 causes the piles to almost "automatically" align while they are driven into the soil by providing the limit to the depth, to which the pile can be driven in relation to the connector 10 and to the subsequent pile segments.

During experimental tests of the pile connector 10, the pile connector 10 was constructed with two pipe portions, each about 4" long, welded to the plate 22. The pile connector had a 6¼" I.D. and about 6⅝" O.D. The wall thickness of the connector was about 3/16". The plate 22 was made about 3/16" thick and about 6" of the wall 16 length were driven into the pile sections. The piles were tested for compression which could withstand up to 50,000 pounds in loads with deflection of 0.08 inches.

The piles were also tested for bending. The rate of loading was approximately 3,000 pounds per minute. The flexural test demonstrated that the pile sections could withstand up to about 9 PL/4 (ft/kips). Different pile sections were also tested for pull out (uplift) readings and when the pile diameters (top/bottom) were used in the range of 7.2 inches/10.4 inches, the ultimate load in pounds was 9,500. Of course, with different diameter wood sections and different size connectors, different readings would be achieved.

The connector 10 of the present invention can be used for driving woodpiles regardless of whether the cut of the abutting sections was straight or uneven. The tests show that 15 or more degrees bevel was still acceptable with a proper alignment of the piles.

The pile connector 10 is preferably made of a strong material, such as steel that can withstand loads associated with driving of the piling into the ground. It can also be manufactured from a material having corrosion resisting properties. The connector 10 can be made of tubular material having circular or rectangular cross-section. The length and thickness of the wall 16 will depend in the diameter of the logs forming the pile system.

Many changes and modifications can be made in the design of the present invention without departing from the spirit thereof. I, therefore, pray that my rights to the present invention be limited only by the scope of the appended claims.

I claim:

1. A connector for engaging sections of a wood piling, comprising:

a tubular body having an open upper end, an open lower end, an outer wall, an inner wall and a longitudinal axis; and a separating plate fixedly attached to the inner wall in a transverse relationship to the longitudinal axis, said separating wall dividing the tubular body into an upper portion and a lower portion, said upper portion being configured and adapted for inserting into a bottom end of a first piling section and said lower portion being configured and adapted for inserting into a top end of second piling section that is positioned below the first piling section, said separating plate being provided with at least one air-and-fluid bleed opening adjacent a junction of the separating plate and the tubular body, said at least one bleed opening being configured to allow escape of air and fluid from interior of the tubular body.

2. The device of claim 1, wherein said separating plate is provided with a pair of bleed openings to allow for escape of air and fluid from interior of the tubular body, said bleed openings being formed in spaced-apart locations in said separating plate.

3. The device of claim 1, wherein said open upper end of the upper portion is defined by a continuous wall having an inwardly inclined bevel edge to facilitate insertion of the upper portion into a wood piling section, thereby causing compression of the piling section at the place of the insertion.

4. The device of claim 1, wherein said open lower end of the lower portion is defined by a continuous wall having an inwardly inclined bevel edge to facilitate insertion of the lower portion into a wood piling section, thereby causing compression of the piling section at the place of the insertion.

5. The device of claim 1, wherein said separating plate is fixedly attached between said inner wall and said outer wall.

6. A method of connecting adjacent sections of wood piling, comprising the steps of:

providing a tubular connector body having an open upper end, an open lower end, an outer wall, an inner wall and a longitudinal axis;

securing a separating plate to the inner wall in a transverse relationship to the longitudinal axis, said separating wall dividing the connector body into an upper portion and a lower portion, said separating plate being provided with at least one air-and-fluid bleed opening adjacent a junction of the separating plate and the connector body, inserting the lower portion into a top end of a first pile section until at least a part of an upper surface of the first pile section contacts the separating plate;

lowering a second pile section to rest on the upper portion and forcing the second pile section downwardly, thereby inserting the upper portion into a bottom of the second pile section until at least a part of a bottom surface of the second pile section contacts the separating plate, thereby connecting the first pile section and the second pile section, while allowing air and fluid to escape said connector body through said at least one bleed opening.

7. The method of claim 6, wherein said open upper end of the upper portion of the pile connector is defined by a continuous wall having an inwardly inclined bevel edge for causing compression of the pile section being forced in the upper portion.

8. The method of claim 6, wherein said open lower end of the lower portion of the pile connector is defined by a continuous wall having an inwardly inclined bevel edge for causing compression of the pile section being forced in the lower portion.

9. The method of claim 6, wherein said separating plate is fixedly attached between said inner surface and said outer surface.

10. The method of claim 6, further comprising a step of forming a pair of spaced-apart bleed openings in said separating plate for release of air and fluid from said connector body.

11. A connector for engaging sections of a wood piling, comprising:

a tubular connector body having a longitudinal axis and an exterior surface, said connector body comprising an upper portion having a tubular wall with an open upper end and a lower portion having a tubular wall with an open lower end, the lower portion being fixedly connected to the upper portion; and a separating plate fixedly attached between the upper portion and the lower portion in a transverse relationship to the longitudinal axis of the connector body, said separating plate being provided with a pair of spaced-apart air-and-fluid bleed openings formed at spaced-apart location adjacent a junction of the connector body and the separating plate, said bleed opening being configure to release of air and fluid from said connector body.

12. The device of claim 11, wherein said open upper end of the upper portion is defined by a continuous wall having a bevel edge to impart compression on a section of wood piling being forced into the upper portion.

13. The device of claim 11, wherein said open lower end of the lower portion is defined by a continuous wall having a bevel edge to impart compression on a section of wood piling being forced into the lower portion.

14. The device of claim 11, wherein said connector body has an inner surface, and wherein said separating plate is secured to said connector body between said inner surface and said exterior surface.

* * * * *